United States Patent [19]

Grünewälder et al.

[11] 3,933,425

[45] Jan. 20, 1976

[54] METHOD OF CLEANING TEXTILES

[75] Inventors: Werner Grünewälder, Haan Rhineland; Herbert Frotscher, Langenfeld Rhineland, both of Germany

[73] Assignee: Henkel & Cie GmbH, Dusseldorf-Holthausen, Germany

[22] Filed: June 29, 1973

[21] Appl. No.: 375,097

[30] Foreign Application Priority Data

July 1, 1972 Germany ..... 2232397

[52] U.S. Cl. ..... 8/142; 8/137; 252/90

[51] Int. Cl.[2] ..... D06L 1/02

[58] Field of Search ..... 8/137, 142; 252/90

[56] References Cited

UNITED STATES PATENTS

| | | | |
|---|---|---|---|
| 3,274,294 | 9/1966 | Stanton et al. | 8/168 C |
| 3,424,545 | 1/1969 | Baumann | 8/137 |
| 3,650,673 | 3/1972 | Ehner | 8/137 |
| 3,652,198 | 3/1972 | Farber | 8/168 C |
| 3,667,898 | 6/1972 | Bergman et al. | 8/94 |
| 3,673,110 | 6/1972 | Edwards | 252/90 |
| 3,716,488 | 2/1973 | Kolsky | 8/137 |

OTHER PUBLICATIONS

Berch, Tex. Res. S. Vol. 35, No. 3, Mar. 1965, pp. 252–260.

Pittman et al. J. of Amer. Tex. Chem. & Col.

Peper et al. Amer. Dyestuff Reporter, 1964, pp. 36–42.

*Primary Examiner*—Donald Levy

*Attorney, Agent, or Firm*—Hammond & Littell

[57] ABSTRACT

A method of chemically cleaning textiles in organic solvents with the use of cleaning intensifiers and small quantities of water, comprises bringing the solvents during the cleaning operation into contact with inorganic or organic adsorption materials which are provided with an insolubly fixed impregnation of polycondensation products containing polyalkylene glycol units.

11 Claims, No Drawings

METHOD OF CLEANING TEXTILES

THE PRIOR ART

Greying of the textiles, giving rise to complaints, can readily occur when chemically cleaning white or pastel-colored textiles. Such difficulties cannot always be avoided despite increased precautionary measures such as the use of freshly distilled solvents, cleaning intensifiers which have as light a color as possible, antistatic material and the like, and cleaning with a low level of liquor. The reasons for this greying resides in the nature and the special sensitivity of many fibrous materials, the moisture content of the material to be cleaned and the cleaning liquor, and particularly in the dirt content of the liquor. Therefore, it has already been proposed to add adsorption agents such as wood flour, filter paper, fibrous textile materials etc. to the cleaning liquor in order to remove from the solvent the detached, water soluble dirt which is chiefly responsible for the greying of the textiles. Furthermore, attempts have been made to solve the said problems by careful filtration of the solvents during the cleaning operation. However, it has been found that the said measures were not able to reliably prevent greying.

OBJECTS OF THE INVENTION

It is an object of the present invention to reduce the risk of or to prevent the greying, during chemical cleaning, of textiles particularly white or pastel-colored textiles.

It is another object of the present invention to provide a development in the method of chemically cleaning a textile in an organic solvent which comprises contacting a textile with an organic solvent containing cleaning intensifiers and a small quantity of water, separating said textiles from said solvent and recovering said cleaned textile, wherein the improvement comprises bringing said organic solvent during the cleaning operation into substantially continuous contact with an adsorption material having an insolubly fixed impregnation of a polycondensation product containing polyalkylene glycol units, said contacting with said adsorption material being selected from the group consisting of (1) passing said organic solvent through a layer of said adsorption material in particulate form, (2) passing said organic solvent through a continuous porous sheet of said adsorption material in the presence of said textile and (3) passing said organic solvent through a continuous porous sheet of said adsorption material in the absence of said textile.

These and further objects of the invention will become apparent as the description thereof proceeds.

DESCRIPTION OF THE INVENTION

The present invention relates to a method of chemically cleaning textiles. In general the invention relates to a method of chemically cleaning textiles in organic solvents, the solvents being treated with impregnated adsorption or filter materials, having an increased adsorptive power for dirt, for the purpose of preventing the greying of the textiles during the cleaning operation.

More particularly the present invention provides a method of chemically cleaning textiles in organic solvents with the use of cleaning intensifiers and small quantities of water, in which method during the cleaning operation, the solvents are brought into contact with inorganic or organic adsorption or filter materials which are provided with an insolubly fixed impregnation of polycondensation products or polymers containing polyalkylene glycol units. Specifically the present invention is directed to a development in the method of chemically cleaning a textile in an organic solvent which comprises contacting a textile with an organic solvent containing cleaning intensifiers and a small quantity of water, separating said textile from said solvent and recovering said cleaned textile, wherein the improvement comprises bringing said organic solvent during the cleaning operation into substantially continuous contact with an adsorption material having an insolubly fixed impregnation of a polycondensation product containing polyalkylene glycol units, said contacting with said adsorption material being selected from the group consisting of (1) passing said organic solvent through a layer of said adsorption material in particulate form, (2) passing said organic solvent through a continuous porous sheet of said adsorption material in the presence of said textile and (3) passing said organic solvent through a continuous porous sheet of said adsorption material in the absence of said textile.

The present invention is further directed to an adsorption material for solvent filtration during the chemical cleaning of textiles comprising a filter made from adsorption a material selected from the group consisting of keiselguhr, textile fibers, paper, and the mixtures thereof, said adsorption material having an insolubly fixed impregnation of a polycondensation product containing polyalkylene glycol units.

The cleaning method in accordance with the invention uses the conventional solvents employed in chemical cleaning, such as halogenated methane and ethane solvents for example trichloroethylene, trichloroethane, carbon tetrachloride, perchloroethylene or monofluorotrichloromethane, aliphatic hydrocarbon solvents for example benzine, heavy benzine (b.p. 145°–200°C) etc. So-called cleaning intensifiers are added to these solvents with the cleaning intensifiers usually being anionic surface-active compounds or nonionic surface-active compounds selected from the group consisting of higher alkyl sulfates, higher alkyl ether sulfates, higher alkyl sulfonates, higher alkylbenzene sulfonates, mono- or di-higher alkyl sulfosuccinates or the alkylene oxide adducts to higher fatty alcohols, to higher alkyl phenols or the like, the alkyl chain of the said compounds having 8 to 20 carbon atoms. Furthermore, small quantities of water, preferably about 1 to 2 percent by weight based upon the textile material used, are added to the cleaning liquors in order to promote the releasing of the water-soluble dirt with a relative humidity of 70 to 85% being maintained above the cleaning liquor.

Preferably, the method of cleaning the textile is carried out in such a manner that the cleaning liquor is pumped through a filter in order to remove water-soluble or water-dispersed dirt during the cleaning operation. However, absorbent substances may be added directly to the cleaning liquor in the presence of the textile. The adsorption or filter materials may comprise fine-particulate, inorganic or organic materials in powdered or granulated form such as kieselguhr, polystyrene foam powder or polyurethane foam powder which can be utilized as a filter aid or may comprise fibrous materials made from inorganic or organic, natural or synthetic materials such as cellulose, albumen, polyamide, polyurethane, polyacrylonitrile, polyester, polyvinyl chloride, polyethylene or the like in the form of a continuous porous sheet such as textile fabrics, knitted fabrics, flocks, felts, filter plugs, filter cartridges or filter papers. Since the adsorptive power of these materials is inadequate for the amount of dirt contained in the liquor, they are provided, in accordance with the invention, with an insolubly fixed impregnation of polycondensation product or polymers containing polyalkylene glycol units. Unexpectedly, it has been found that this impregnation considerably improves the adsorptive power of the impregnated materials with respect to the water-soluble dirt.

Polycondensation products or polymers containing 20 to 97 percent by weight, preferably 40 to 80 percent by weight, of polyalkylene glycol units are suitable for impregnating the adsorption or filter materials. The polyalkylene glycol units are composed of units of alkylene glycol or alkylene oxide having 2 to 4 carbon atoms. They are produced preferably by polymerizing ethylene oxide and/or propylene oxide or by adding these alkylene oxides, together with butylene oxide, to compounds having reactive hydrogen atoms, for example alcohols, carboxylic acids, amines, carbonamides, and the like. These oxyalkylated compounds contain 3 to 100 alkylene oxide units per molecule and have a molecular weight of from 200 to 2000, preferably from 500 to 1000.

Suitable polycondensation products or polymers having a content of the above-mentioned polyalkylene glycol units can be manufactured in a variety of ways. Suitable starting materials are virtually all reactive compounds which permit polyalkylene glycols, or compounds containing polyalkylene glycol units to be introduced into polycondensation products or polymers, provided they can be applied to the filter materials in the form of their starting components or in the form of soluble preliminary condensation products or prepolymers and can be fixed thereto in an insoluble manner. By way of example, this can be effected by a drying process or by thermal after treatment.

Examples of suitable products include the water-soluble preliminary condensation products formed from aminotriazines or their derivatives, oxo-compounds and polyalkylene oxides, according to U.S. Pat. No. 2,986,479. Condensable aminotriazines, which may be used are melamine or aminotriazine derivatives such as hydroxydiaminotriazine. Oxo-compounds which may be used include primarily formaldehyde and formaldehyde yielding compounds, such as paraformaldehyde, trihydroxymethylene, and methylaldehyde, as well as other aldehydes and ketones. Polyalkylene oxides which may be used include polyoxyethylene glycols having a molecular weight of from 300 to 2000, preferably from 600 to 1000. However, the corresponding polymerization products of other alkylene oxides such as propylene oxide, epichlorohydrin and mixed polymerizates of different alkylene oxides, may be used. One mol of aminotriazine is condensed with 5 to 6 mols of oxo-compound and 1–3 mols of the polyalkylene oxide. The water-soluble derivatives can be insolubly impregnated on drying at 100°C to 150°C. Examples of other suitable products include those according to U.S. Pat. No. 3,163,556 based upon the soluble preliminary condensation products formed by aminotriazines or their derivatives with oxo-compounds and polyalkylene oxides as described in U.S. Pat. No. 2,986,479 (A) in which the condensates of triazines and oxo-compounds are replaced by condensation products formed by urea and glyoxal and/or their alkylol derivatives such as the methylol derivative derived from formaldehyde, and/or (B) in which the polyalkylene oxides are replaced by addition products of alkylene oxides, especially of ethylene oxide with compounds which contain exchangeable hydrogen atoms which are attached to the molecule through oxygen, sulfur or nitrogen atoms.

Examples of suitable alkylene oxide addition products according to the present invention are oxoalkylation products of mono- or polyalcohols, phenols, alkyl phenols, mono- and polyvalent carboxylic acids, mono- or polyvalent polycarboxylic acid amides, mono- or polyvalent alkyl amines, alkylol amines, fatty acid alkylol amides, fatty acid trialkylol amino esters and the like. The hydrocarbon radical of the compounds may belong to the aliphatic, cycloaliphatic or aromatic or fatty aromatic series and should contain about 1 to 30 carbon atoms in the molecule. The amount of alkylene oxide, especially ethylene oxide, which is added should amount to about 3 to 100 mols per 1 mol of compound containing the exchangeable hydrogen atom. More particularly, they are, therefore, addition products of alkylene oxides and fatty alcohols, fatty acids, naphthenic acids, resin acids, di- or polycarboxylic acids, ammonium, mono-, di- and trialkylol amines, glycols, glycerin, pentaerythrite, trimethylol propane, sugar alcohols, alkylene diamines, di-alkylene triamines etc.

More particularly, the preferred polycondensation products in accordance with U.S. Pat. No. 2,986,479 and U.S. Pat. No. 3,163,556 is a reaction product of a component (a) selected from the group consisting of water-soluble melamineformaldehyde condensates and water-soluble urea-glyoxal-formaldehyde condensates with a component (b) selected from the group consisting of polyalkylene oxides, such as polyethylene oxides, and products of addition of alkylene oxides to a compound selected from the group consisting of phenols, fatty alcohols, fatty acids, fatty acid amides, alkylamines, and alkylolamines.

Also suitable are the water-soluble preliminary polycondensation products manufactured in accordance with U.S. Pat. No. 3,347,803 which teaches a process for the preparation of hardenable water-soluble synthetic resinous products containing halohydrin groups which comprises reacting at a temperature from 50° to 100°C. (A) a member selected from the group consisting of polyamines, aqueous ammonia and mixtures thereof with (B) a polylower alkylene oxide derivative having 3 to 70 alkylene oxide units and having more than one halohydrin group in the molecule, the molar ratio of A to B being selected so that the number of halohydrin groups to the number of reactive hydrogen atoms attached to a nitrogen atom is 4:5 to 7:5 in the presence of acid binding agents selected from the group consisting of alkali metal hydroxides, alkali metal carbonates and alkali metal bicarbonates, and alkaline earth metal carbonates, continuing said reaction until the reaction mixture reached a pH of between 7 to 7.5, and thereafter discontinuing said reaction by acidification to a pH of less than 6, whereby stabilized, incompletely condensed, water-soluble resins are obtained which are readily hardenable in an alkaline medium.

Also suitable are the water-soluble preliminary polycondensation products manufactured in accordance with German Pat. No. 1,419,042 and disclosed in U.S.

Pat. No. 3,347,803, in which the polycondensation product consists of the reaction product of a component (a) selected from the group consisting of a water-soluble compound having reactive amino groups containing polyalkylene oxide units and water-soluble polyamines containing polyalkylene oxide units reacted with a component (b) selected from the group consisting of epichlorohydrin and compounds having more than one substituent selected from the group consisting of epoxide, halogenhydrin, and the mixtures thereof in the molecule.

Further examples of suitable polycondensation products are those produced in accordance with German Pat. No. 1,445,217 and disclosed in U.S. Pat. No. 3,347,803 which teaches water-soluble polyvalent amines obtained by condensation of a component (a) selected from the group consisting of polychlorohydrin ethers of polyalkylene oxides and polychlorohydrin ethers of compounds having polyalkylene oxide reacted with a component (b) selected from the group consisting of ammonia and mixtures of ammonia and polyvalent amines, further reacted with a component (c) selected from the group consisting of epichlorohydrin ethers of polyols, dichlorohydrin ethers of polyols, bischlorohydrin ethers of polyols, and the mixtures thereof.

Preferred examples of polycondensation products include (1) the reaction product of a bischlorohydrin ether of a polyethylene glycol having a molecular weight ranging from 600 to 1000 condensed with dipropylene triamine and reacted with epichlorohydrin, (2) the reaction product of ethylene chlorohydrin containing polyethylene oxide reacted with diethylenetriamine and reacted with epichlorohydrin (3) a reaction product of dipropylenetriamine with a bischlorohydrin ether of a polyethylene glycol having a molecular weight ranging from 600 to 1000, and (4) the reaction product from melamine formaldehyde and polyethylene glycol having a molecular weight ranging from 600 to 1000.

The above-mentioned soluble condensation products can readily be applied to the absorption or filter materials from aqueous solution and can be fixed in an insoluble manner by means of a subsequent drying process with temperatures increased to 150°C if required, or by adding acid-binding catalysts to the impregnating solution. The condensation products can also be readily and fully applied to the adsorption or filter materials from diluted aqueous solution, so that the impregnating solutions can be utilized to good advantage. The components required to manufacture the condensation products, such as polyalkylene oxides or products of addition of alkylene oxide, melamine, urea, formaldehyde, glyoxal, polyamines, ammonia, polyepoxide or halohydrin compounds in a non-precondensed form, can be used for impregnation instead of the preliminary condensation products and can be condensed and hardened by suitable measures such as adding acids or acid-forming catalysts or acid-binding agents and/or by thermal treatment.

Further suitable polycondensation products or polymers can be obtained, in accordance with Belgian Pat. No. 560,446, from polyalkylene glycol polyamines and polyalkylene glycol diiodide or, in accordance with the British Pat. No. 805,549, by polymerization of acrylic acid polyalkylene glycol esters. In this instance the cross-linking or polymerization is also carried out on the filter material by the effect of increased temperature in the presence of acid-binding agents, or suitable catalysts if required.

The impregnating agents are applied to the adsorption or filter materials in quantities of approximately 0.1 to 30% by weight, preferably 1 to 15% by weight. Impregnation is effected with diluted aqueous solutions of the soluble polycondensation products or polymers by saturating, immersing, or spraying the materials to be impregnated. Advantageously, the impregnating solutions contain approximately 15 to 30% by weight of the soluble polycondensation products or polymers and, if required, auxiliary solvents such as lower alcohols having 1 to 3 carbon atoms. After the surplus solution has been allowed to drain off or has been centrifuged or squeezed out, the impregnated material is dried and, if required, subjected to thermal after-treatment until the impregnating agent has been fully fixed.

Advantageously, the impregnated materials are used in the form of alluvial filters, filter plugs or filter cartridges through which the liquid is pumped in a substantially continuous fashion. By way of example, textile fiber plugs or charges of keiselguhr, particularly finished filter cartridges made from paper materials, are suitable. The impregnated materials may also be added to the cleaning liquor itself in the form of pieces of textile fabric, or in granulated or powder form, or the like. Normally, the impregnated materials will be used in the conventional manner instead of the adsorption or filter materials normally used. The impregnated materials collect the detached dirt to a sufficient extent during the course of the cleaning operation, this manifesting itself in a clearly preceptible darkening of the color of the adsorption or filter materials. After these materials have been completely saturated with dirt, they are exchanged for freshly-impregnated filter materials.

The present invention has the advantages of overcoming the difficulties previously involved in the cleaning of light or pastel-colored textiles and gives excellent cleaning results with extremely low costs and expenditure of labor. There is not need to adapt the cleaning process or modify the cleaning machines and apparatus. The following examples illustrate the invention without limiting it in any respect.

EXAMPLE 1

6 kg of soiled light-colored ladies outer garments, made from rayon, polyester and polyacrylonitrile, were cleaned for 10 minutes without filtration of the cleaning fluid in a Bowe R9 cleaning apparatus in 80 liters of perchloroethylene with the addition of 5 gm/liter of a conventional anionic sulface-active cleaning intensifier comprising:

30% sulfosuccinic acid oleyl ester
14% dodecylbenzene sulfonate
14% alkylphenol-ethylene oxide-adduct having about 9 to 12 carbon atoms in the alkyl and 10 ethylene oxide units
10% water
remainder solvent and 1% water based on the weight of the articles, which were then spin-dried and then dried in a conventional manner.

1 liter of the cleaning liquor was removed from the cleaning machine after the second, fourth, sixth, eighth and tenth minute, and these samples were used in a mixed state as a test liquor for the cleaning tests described hereinafter.

A laboratory cleaning apparatus having a capacity of holding 100 gm of textiles and 1 liter of test liquor was charged with the test quantities of the cleaning liquor from the cleaning machine. A Scheibler laboratory filter having a filter area of 0.04 $m^2$ was connected to the apparatus. The textile material used was 25 gms each of white knitted material made from wool, or polyacrylonitrile or polyester, and 25 gm of a mixed fabric made from wool and polyester (45:55). The cleaning time was 10 minutes with a liquor temperature of 25°C. The liquor was clarified by the connected filter during the entire cleaning time. 6 gm keiselguhr and 1.5 gm/liter of the above-mentioned cleaning intensifier, and 1% water, based upon the weight of the articles, were added to the liquor as filtering aids before the cleaning operation began.

At the end of the cleaning time, the cleaning liquor was drained off, the test fabric was centrifuged to a residual moisture of 40% in a centrifuge and dried for 15 minutes at 60°C. The degree of whiteness of the test fabric thus cleaned was determined by means of a reflectometer. The greying of the test pieces were calculated from the degrees of whiteness in accordance with the following formula:

$$\% \text{ greying} = \frac{Wo - Wv}{Wo} \times 100$$

Wo = degree of whiteness of the uncleaned fabric
Wv = degree of whiteness of the cleaned fabric.

In a test of the process of the invention, 6 gm keiselguhr were used as a filtering aid which had been treated for 5 minutes at 25°C in a 25% aqueous solution of the following polycondensation product adjusted to a pH value of approximately 11 with a concentrated aqueous solution of sodium hydroxide, with the addition of 1 gm/liter of a commercially available nonionic wetting agent, coconut fatty alkyl + 9 ethylene oxide adduct. After centrifuging, the filtering aid was dried to a residual moisture of 100% at 140°C thus fixing the polycondensation product.

The polycondensation product was manufactured in the following manner: 355 gm of bischlorohydrin ether of a polyethylene glycol having a molecular weight of 1000 were condensed with 44 gm of dipropylene triamine at an increased temperature until the pH value of the reaction mixture was below 8.5. After cooling to about 60°C, 30 gm epichlorohydrin were added and maintained at this temperature for 50 to 60 minutes until the pH value had dropped to about 7. The reaction product was then made up with water to 600 gm of the finished product.

The following greying values were calculated after measuring the degree of whiteness; and the results are compiled in Table 1 below.

Table 1

| Method | Percent Greying with wool knitted fabric | polyacrylonitrile knitted fabric | polyester knitted fabric | wool/polyester fabric |
|---|---|---|---|---|
| Normal | 10 | 8 | 7 | 11 |
| In accordance with invention | 3 | 1 | 0.8 | 2 |

EXAMPLE 2

Cleaning tests were carried out under the same conditions in the laboratory cleaning apparatus described in Example 1. However, instead of the keiselguhr, 0.5 gm of a wool fabric was added to the test liquor with the test materials. In the comparison test, a wool fabric was impregnated with a 20% aqueous solution of the following polycondensation product adjusted to a pH value of 9.8 to 10 with a concentrated aqueous solution of sodium hydroxide and applied to the fabric by foularding. Drying was effected at 120°C, after enough of the absorbed liquor was squeezed out of the wool fabric such that the remaining absorbed liquor was 100% to 120% by weight of the wool fabric.

The polycondensation product was manufactured in the following manner: 290 gm (approximately 0.3 mol) of a reaction product of 1 mol ethylene chlorohydrin and 20 mols ethylene oxide were mixed with 33 gm (approximately 0.3 mol) diethylenetriamine for 4 hours at 120°C under reflux. The reaction mixture was then cooled to approximately 60°C, 100 gm water and 55 gm epichlorohydrin were added and mixing was continued at 55° to 60°C for 1.5 to 2 hours until the pH value of the reaction mixture had dropped to about 7. The viscous product obtained was adjusted to pH 6 with hydrochloric acid and made up to 510 gm with water.

The following greying values were calculated after measuring the degree of whiteness; and the results are compiled in Table 2 below.

Table 2

| Method | Percent Greying with wool knitted fabric | polyacrylonitrile knitted fabric | polyester knitted fabric | wool/polyester fabric |
|---|---|---|---|---|
| Normal | 10 | 8 | 7 | 11 |
| In accordance with invention | 1 | 0.5 | 0.2 | 1 |

As may be seen from the values shown in the table, the wool fabric impregnated with the polycondensation product largely absorbed the contaminants, for example the dirt, present in the test liquor. Thus, the greying of the test pieces of textile could be reduced to a minimum.

EXAMPLE 3

6 kgm of soiled, light-colored ladies outer garments were cleaned in the Bowe cleaning apparatus in the manner described in Example 1. However, 1,1,1-trichloroethane was used as a solvent instead of perchloroethylene. The test liquor thus obtained was used for the greying tests in the laboratory cleaning apparatus in the manner described in Example 1. 4 gm keiselguhr and 2 gm polyurethane, foam powder having a particle size of 0.01 to 8 mm were used as adsorption material. In a corresponding comparison test, a polyurethane foam powder was used which was impregnated by treatment with 200 gm of the following polycondensation product, 6 gm sodium hydrogen carbonate and 5 gm of a cationic active plasticizer, (a fatty acid alkanolamide) in a liter of water. The treatment lasted for 5 minutes at 25°C. The substance was subsequently centrifuged to a residual moisture content of 80% and was dried in a conventional manner at 100°C.

The polycondensation product was manufactured in the following manner: 13.2kgm dipropylenetriamine, 35kgm of 40% aqueous solution of sodium hydroxide and 150kgm of water were added to 236kgm of bis-chlorohydrin ether of a polyethylene glycol having a molecular weight of 600, and heated to boiling for 40 minutes after reflux. After this period of time, the pH value of the viscous reaction mixture had dropped to 7.2. The final pH valve was adjusted to 5.5 by adding 66kgm of 10% hydrochloric acid.

The degree of greying was determined after drying the cleaned test pieces. The following values were obtained and are compiled in Table 3.

Table 3

| Filter Aid Keiselguhr | Percent Greying with wool knitted fabric | polyacrylo-nitrile knitted fabric | poly-ester knitted fabric | wool/poly-ester fabric |
|---|---|---|---|---|
| plus untreated polyurethane powder | 8 | 6 | 5 | 9 |
| plus treated polyurethane powder | 1 | 1 | 0.5 | 1.5 |

EXAMPLE 4

6 kgm of soiled light-colored ladies outer garments were cleaned in trichloroethylene in the Bowe cleaning apparatus utilizing the procedure described in Example 1. The samples taken from the cleaning liquor in the described manner were used in the laboratory cleaning apparatus under the same conditions with the only difference being that, after passing through the Scheibler filter, the liquor passed through a special filter containing 1 gm of nylon flock. Nylon flock material, which had been impregnated with a polycondensation product corresponding to Example 1, was used in a corresponding comparison test.

The following greying values were ascertained and are reported below in Table 4.

Table 4

| Nylon flock | Percent Greying with wool knitted fabric | polyacrylo-nitrile knitted fabric | polyester knitted fabric | wool/poly-ester fabric |
|---|---|---|---|---|
| Untreated | 14 | 10 | 9 | 16 |
| Treated | 4 | 2 | 2 | 5 |

EXAMPLE 5

6 kgm of soiled light-colored ladies outer garments made from the fibrous materials rayon, polyester and polyacrylonitrile were cleaned for 10 minutes without filtration in a cleaning apparatus of the Bowe-Vacumat type in 90 liters of monofluorotrichloromethane with 1% water based upon the weight of the articles and with the addition of 5 gm/liter of a conventional cleaning intensifier comprising:

40% Sodium petroleum sulfonate (62%, molecular weight approximately 460, the remainder mineral oil)

10% Oleyl alcohol

20% of the adduct of 9 mols ethyleneoxide to nonylphenol

10% Water

Remainder monofluorotrichloromethane.

The articles were then centrifuged and dried in a conventional manner. The liquor was removed in the same manner as described in Example 1. The comparison test was carried out under the condition described in Example 1. After passing through the Scheibler filter, the cleaning liquor passed through a special filter in which the filter element was a paper filter manufactured by the firm Machery, Nagel & Co., size 32 cm diameter, number 6161/4.

A paper filter impregnated in accordance with the invention was used in a further test, in which the polycondensation product utilized was that described in Example 1 and applied as in Example 1.

The following greying values were calculated and are compiled in Table 5 below.

Table 5

| Filter material | Percent Greying with wool knitted fabric | polyacrylo-nitrile knitted fabric | polyester knitted fabric | wool/poly-ester fabric |
|---|---|---|---|---|
| Untreated Paper | 7 | 6 | 4 | 7 |
| Treated Paper | 1 | 0.5 | 0.3 | 1.5 |

The dirt in this test was also absorbed to a substantially greater extent by the impregnated paper filter than by the non-impregnated paper filter.

EXAMPLE 6

10 kgm of soiled, light-colored ladies outer garments made from the fibrous materials cotton, rayon, polyester and polyacrylonitrile were cleaned for 20 minutes without filtration in a cleaning apparatus of the Hoffmann Jet 15 type in 200 liters of heavy benzine, boiling range 145°C to 200°C, with the addition of 5 gm/liter of a conventional cleaning intensifier and 1.5% water based upon the weight of the articles. The clothing was then centrifuged and dried in a tumbler. After 2,6,10, 14 and 20 minutes respectively quantities of 500 $cm^3$ of the liquor were removed and, after mixing, were used as a test liquor for further tests. The laboratory cleaning apparatus described in Example 1 was used, although the Scheibler filter was covered with a cotton fabric instead of a polyester fabric. The cleaning time was 20 minutes. The comparison test was carried out with a cotton fabric which had been impregnated with the polycondensation product as described in Example 1. As is shown by the following greying values in Table 6, the greying is considerably less when using the filter impregnated in accordance with the invention than when using the conventional method.

Table 6

| Filter material | Percent Greying with wool knitted fabric | polyacrylo-nitrile knitted fabric | polyester knitted fabric | wool/poly-ester fabric |
|---|---|---|---|---|
| Untreated Cotton | 6 | 5 | 5 | 7 |
| Treated Cotton | 1 | 0.3 | 0.1 | 1 |

EXAMPLE 7

Cleaning tests were carried out under the same conditions in the laboratory cleaning apparatus described in Example 1. However, instead of the keiselguhr, 0.5 gm of a polyester fabric was added to the test liquor together with the test materials. A treated polyester fabric, which had been foularded with 250 gm of the following condensation product in 1 liter of water with the addition of 4 gm ammonium nitrate and dried at 80°C to 100°C, was used in the comparison test.

The condensation product was manufactured in the following manner: 1 mol melamine, 6 mols 30% formaldehyde and 2 mols polyethyleneglycol of molecular weight 1000 were mixed and heated to 85°C for 10 minutes. The reaction mixture was then heated to boiling with further mixing and distilling off of the water until the temperature of the fluid had increased to 130°C. The reaction was then terminated and the preliminary condensation product was used for treatment.

The following greying values were calculated; and are reported in Table 7 below.

Table 7

| Method | Percent Greying with wool knitted fabric | polyacrylonitrile knitted fabric | polyester knitted fabric | wool/polyester fabric |
|---|---|---|---|---|
| Normal | 10 | 8 | 7 | 11 |
| In accordance with the invention | 2 | 0.5 | 0.4 | 0.8 |

Although the present invention has been disclosed in connection with a few preferred embodiments thereof, variations and modifications may be resorted to by those skilled in the art without departing from the principles of the new invention. All of these variations and modifications are considered to be within the true spirit and scope of the present invention as disclosed in the foregoing description and defined by the appended claims.

We claim:

1. In the method of chemically cleaning and preventing greying of a textile in an organic solvent which comprises contacting a textile with an organic solvent containing cleaning intensifiers and a small quantity of water, said organic solvent being selected from the group consisting of halogenated methane and ethane solvents and aliphatic hydrocarbon solvents, separating said textile from said solvent and recovering said cleaned textile, the improvement which comprises bringing said organic solvent during the cleaning operation into substantially continuous contact with an adsorption material having an insolubly fixed impregnation of a polycondensation product containing polyalkylene glycol units, said polycondensation product containing polyalkylene glycol units being selected from the group consisting of (I) a reaction product of a component (a) selected from the group consisting of water-soluble melamine-formaldehyde condensates and water-soluble urea-glyoxal-formaldehyde condensates with a component (b) selected from the group consisting of polyalkylene oxides and products of addition of alkylene oxides to a compound selected from the group consisting of phenols, fatty alcohols, fatty acids, fatty acid amides, alkylamines, and alkylolamines, (II) a reaction product of a component (a) selected from the group consisting of polyalkylene polyamines, aqueous ammonia and mixtures thereof with a component (b) consisting of alkylene oxide derivatives having 3 to 70 alkylene oxide units and more than one halogenhydrin in the molecule, (III) a reaction product of a component (a) selected from the group consisting of a water-soluble compound having reactive amino groups containing polyalkylene oxide units and water-soluble polyalkylene polyamines containing polyalkylene oxide units reacted with a component (b) selected from the group consisting of epichlorohydrin and compounds having more than one substituent selected from the group consisting of epoxide, halogenhydrin, and the mixtures thereof in the molecule, and (IV) a water-soluble polyvalent amine obtained by condensation of a component (a) selected from the group consisting of polychlorohydrin ethers of polyalkylene oxides and polychlorohydrin ethers of compounds having polyalkylene oxide reacted with a component (b) selected from the group consisting of ammonia and mixtures of ammonia and polyvalent amines, further reacted with a component (c) selected from the group consisting of epichlorohydrin ethers of polyols, dichlorohydrin ethers of polyols, bischlorohydrin ethers of polyols, and the mixtures thereof, said contacting with said adsorption material consisting of passing said organic solvent through a layer of said adsorption material in particulate form.

2. The method of claim 1, in which said polycondensation product contains from 20 to 97% by weight of polyalkylene glycol units.

3. The method of claim 2, in which said polycondensation product contains from 40 to 80% by weight of polyalkylene glycol units.

4. The method of claim 1, in which said polycondensation product contains a polyalkylene glycol unit selected from the group consisting of polyethylene glycol units, polypropylene glycol units and the mixtures thereof.

5. The method of claim 1, in which said polyalkylene glycol units contains from 3 to 100 oxyalkylene units per molecule.

6. The method of claim 1, in which said polycondensation product consists of a water-soluble hardenable preliminary condensation product for impregnating said adsorption filter material.

7. The method of claim 1, in which said adsorption material is selected from the group consisting of keiselguhr, polyurethane foam powder, and the mixtures thereof.

8. The method of claim 1, in which said adsorption material is impregnated with from about 0.1 to 30% by weight of said polycondensation product.

9. The method of claim 1, in which said polycondensation product is selected from the group consisting of (1) the reaction product of a bischlorohydrin ether of a polyethylene glycol having a molecular weight ranging from 600 to 1000 condensed with dipropylenetriamine and reacted with epichlorohydrin, (2) the reaction product of ethylene chlorohydrin containing polyethylene oxide reacted with diethylenetriamine and reacted with epichlorohydrin, (3) a reaction product of dipropylenetriamine with a bischlorohydrin ether of a polyethylene glycol having a molecular weight ranging from 600 to 1000, and (4) the reaction product from melamine formaldehyde and polyethyleneglycol having a molecular weight ranging from 600 to 1000.

10. The method of claim 1, in which said adsorption material is keiselguhr having an insolubly fixed impregnation of a polycondensation product consisting of the reaction product of a bischlorohydrin ether of a polyethylene glycol having a molecular weight ranging from 600 to 1,000 condensed with dipropylenetriamine and reacted with epichlorohydrin, and in which said contacting with said adsorption material consists of passing said organic solvent through a layer of said impregnated keiselguhr in particulate form.

11. The method of claim 1, in which said adsorption material is a mixture of keiselguhr and polyurethane foam powder, said polyurethane foam powder having an insolubly fixed impregnation of a polycondensation product consisting of a reaction product of dipropylenetriamine with a bischlorohydrin ether of a polyethylene glycol having a molecular weight ranging from 600 to 1,000, and in which said contacting with said adsorption material consists of passing said organic solvent through a layer of said mixture.

* * * * *